US005305554A

United States Patent [19]

Emken et al.

[11] Patent Number: 5,305,554

[45] Date of Patent: Apr. 26, 1994

[54] MOISTURE CONTROL IN VIBRATORY MASS FINISHING SYSTEMS

[75] Inventors: Michael R. Emken; Mark Seeley; David S. Wilde, all of Austin, Tex.

[73] Assignee: Carbon Implants, Inc., Austin, Tex.

[21] Appl. No.: 78,560

[22] Filed: Jun. 16, 1993

[51] Int. Cl.[5] ..... B24B 31/06; B24B 57/02

[52] U.S. Cl. ..... 51/7; 51/263; 51/292; 51/163.1

[58] Field of Search ..... 51/7, 17, 163.1, 292, 51/263, 316

[56] References Cited

U.S. PATENT DOCUMENTS

| | | | |
|---|---|---|---|
| 3,091,060 | 5/1963 | Giegerich et al. | 51/263 |
| 3,305,977 | 2/1967 | Kellard | 51/263 |
| 3,353,796 | 11/1967 | Roberts | 51/163.1 |
| 3,411,248 | 11/1968 | Dwyer et al. | 51/163.1 |
| 3,584,419 | 6/1971 | Hulet et al. | 51/7 |
| 3,855,441 | 12/1974 | Kimmelmann | 219/68 |
| 3,959,932 | 6/1976 | Rampe | 51/163.1 |
| 4,058,935 | 11/1977 | Smilg et al. | 51/163.1 |
| 4,209,947 | 7/1980 | Ohno | 51/7 |
| 4,257,196 | 3/1981 | Walther et al. | 51/316 |
| 4,546,012 | 10/1985 | Brooks | 427/213 |
| 4,884,372 | 12/1989 | McNeil | 51/163.2 |
| 4,934,103 | 6/1990 | Campergue et al. | 51/59 |
| 5,058,326 | 10/1991 | Davidson | 51/163.1 |
| 5,076,026 | 12/1991 | Mizuguchi et al. | 51/317 |

FOREIGN PATENT DOCUMENTS

| | | | |
|---|---|---|---|
| 0537794 | 3/1977 | U.S.S.R. | 51/163.1 |

*Primary Examiner*—Robert A. Rose

*Attorney, Agent, or Firm*—Fitch, Even, Tabin & Flannery

[57] ABSTRACT

A "closed-loop" moisture control system for use in vibratory mass finishing systems. A substantially constant amount of a grinding and/or polishing slurry is maintained in a finishing reservoir of the vibratory mass finishing system by controlling the amount of such fluid flowing from a supply reservoir into the finishing reservoir, and/or the amount of such fluid flowing from the finishing reservoir into a collection reservoir. In operation, a total weight of the supply reservoir and its contents, and of the collection reservoir and its contents is monitored and, in the event there is an increase in the total weight, a control means increases the amount of polishing fluid flowing from the supply reservoir into the finishing reservoir, and/or decreases the amount of polishing fluid flowing from the finishing reservoir into the collection reservoir. Conversely, in the event there is a decrease in the total weight, the control means decreases the amount of polishing fluid flowing from the supply reservoir into the finishing reservoir, and/or increases the amount of polishing fluid flowing from the finishing reservoir into the collection reservoir.

17 Claims, 1 Drawing Sheet

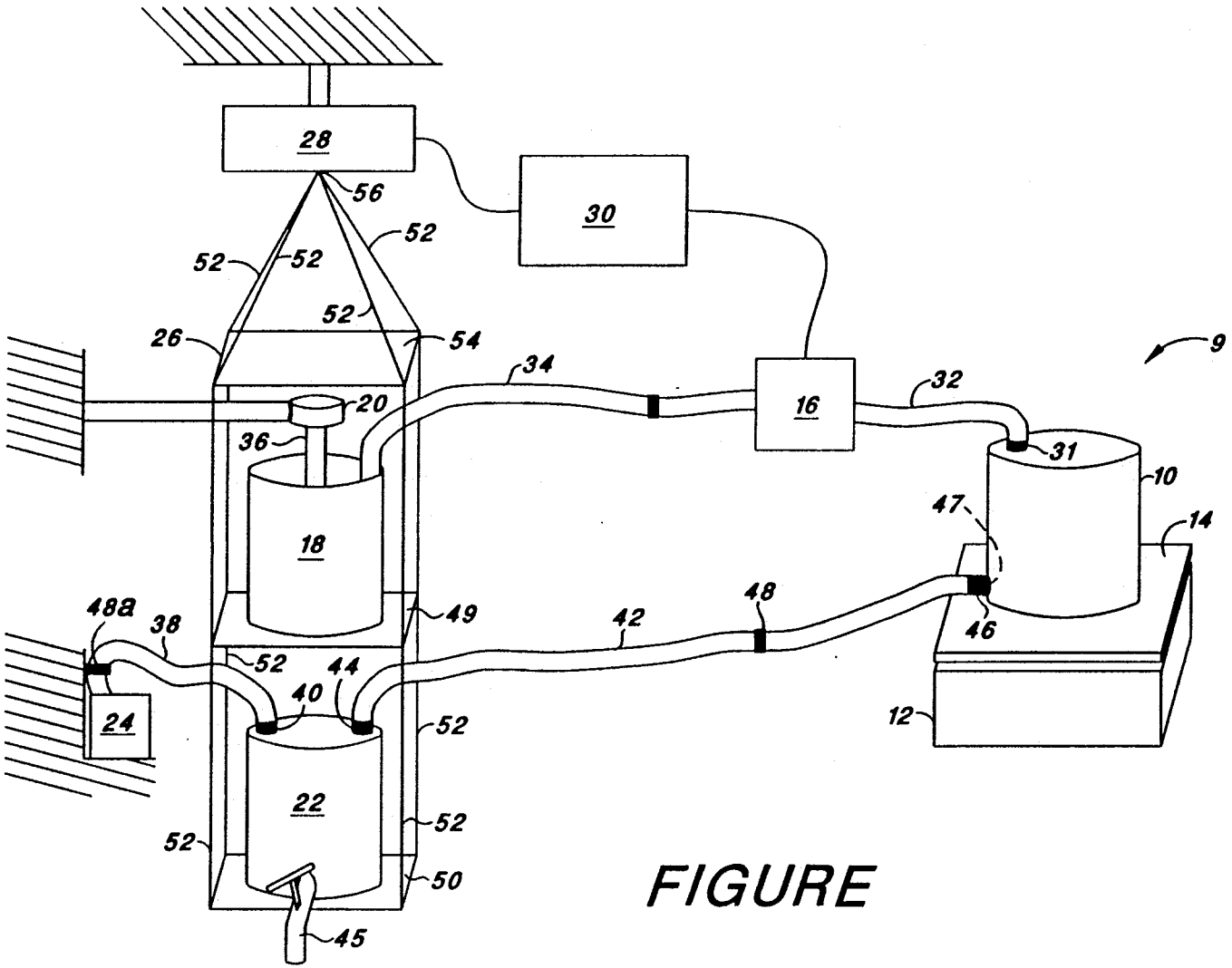
FIGURE

MOISTURE CONTROL IN VIBRATORY MASS FINISHING SYSTEMS

This invention relates to improvements in finishing equipment. More particularly, this invention relates to improvements in equipment that can be used to grind and/or polish articles. Even more particularly, this invention relates to closed-loop moisture control systems for vibratory mass finishing systems.

BACKGROUND OF THE INVENTION

Articles of different kinds are often ground and/or polished by vibrating them in the presence of a grinding and/or polishing material (referred to generically as polishing material). Customarily, a quantity of articles to be polished and a quantity of polishing material are held within a vibratory chamber (or container) of a vibrating device; and the vibrating device applies controlled vibration to the articles and the polishing material so as to provide rapid relative movement between the articles and the polishing material. As a result, the polishing material impacts upon the articles being finished and provides grinding and/or polishing of the articles depending on the polishing material used, i.e., grit size or abrasiveness.

The material used in the grinding and/or polishing applications referred to herein can consist of two grinding and/or polishing components. First, a particulate grinding/or polishing media (referred to generically as polishing media) is used which remains in the vibratory chamber and generally consists of an abrasive or burnishing agent. The polishing media has a relatively large size, e.g., 0.025 in. or larger, and may consist of one or more materials commonly known in the art such as are available from Washington Mills, in Massachusetts and Florida. Second, a liquid grinding and/or polishing fluid or slurry (referred to generically as polishing fluid or slurry) is used which circulates through the chamber; it includes a grinding and/or polishing agent (referred to generically as polishing agent) mixed with water or an oil. The grinding and/or polishing agent is generally a powder, e.g., measured in microns and may include one or more materials such as $A1_2O_3$ or SiC available from suppliers such as Norton Abrasives, K.C. Abrasives in Kansas City and Microgrit. Thus, depending on the particular application, the polishing material may include either grinding agents or polishing agents along with the media.

A polishing slurry tends to provide a pronounced cutting, abrading or grinding action when the polishing slurry is newly introduced into a container of the vibrating device; however, after a period of time, the polishing slurry tends to provide less efficient cutting action. Thus, vibrating devices have been developed wherein fresh polishing slurry is continuously or periodically introduced into the container of the vibrating device, and spent polishing slurry (or discharge slurry) is simultaneously removed from the container.

Dwyer et al., U.S. Pat. No. 3,411,248, shows a vibrating device wherein an admixture of water and grinding and/or polishing agent is introduced into the container of the vibrating device on a substantially continuous basis, and wherein spent grinding and/or polishing agent is similarly cleaned away on a substantially continuous basis.

An alternative approach is shown by Roberts, U.S. Pat. No. 3,353,796. However, steel burnishing balls or beads, used as the polishing media, are retained in a work tub and are not introduced or drained away during the polishing process.

Problematically however, neither Dwyer et al. nor Roberts show a means for responding to changing conditions in the container or work tub, i.e., Dwyer et al. and Roberts show only "open-loop" control systems. For example, various factors such as polishing slurry viscosity and the amount of material worn away from the articles being polished can affect the outflow of polishing slurry from the container or work tub. Similarly, factors such as water pressure can affect the amount of polishing slurry flowing into the container or work tub. Thus, when one or more of these factors causes a change in the inflow (or outflow) of polishing slurry or fluid into the container, without a corresponding change in the outflow (or inflow) from the container, the level of liquid in the container will increase or decease correspondingly. Disadvantageously, if this phenomenon continues, which it is likely to do over an extended period, and corrective steps are not taken by a human attendant, the container will either overflow or contain a less than adequate level of polishing slurry to effectively grind or polish the articles. In either case the desired grinding or polishing process ceases to occur.

Note that there is an optimum amount of polishing slurry that will cause the desired grinding or polishing interaction between the polishing media, polishing agent and the articles. If the polishing fluid level is high or low, the desired interaction will not occur and damage to the articles to be ground and/or polished can occur. The amount of polishing slurry that is the optimum amount of polishing slurry will depend on the particular articles to be polished and the type of polishing slurry and/or polishing media used.

One application in which vibratory polishing and grinding systems are used is in the grinding and polishing of carbon or carbon coated heart valve orifice rings or leaflets. Typically, such heart valve parts are formed using a pyrolytic carbon coating device such as that shown by U.S. Pat. No. 4,546,012 to Brooks, incorporated herein by reference. After being formed, the parts are ready for grinding and polishing to remove excess carbon deposits. Vibratory grinding and polishing systems can effectively be used to perform these grinding and polishing functions. As with other vibratory polishing and grinding applications, the most effective results are achieved when fresh polishing slurry is continuously added to the container and spent polishing slurry (containing pyrocarbon fines) is continuously removed from the container during a grinding or polishing cycle or run. However, because the heart valve parts may contain many small interior surfaces, the grinding or polishing must be done over a period of time, e.g., between six and twenty hours, to allow small-sized polishing media (on the order of thousandths of an inch in diameter) to adequately grind or polish small inside corners of the parts. If systems such as those taught by Dwyer et al. and Roberts were used for heart valve grinding and polishing operations, close attendance would be needed.

Another problem encountered in attempting to control the amount of admixture in the container of a vibratory polishing and grinding system is the intense vibrations (on the order of 2700 to 6000 rpm) to which the container, and any control or measurement means in mechanical contact therewith, are subjected during a typical grinding or polishing run. Such vibrations can cause mechanical damage to and premature failure of most control or measurement means known in the art. Furthermore, even if such vibrations do not cause the failure of control or measurement means, they are likely to cause inaccurate responses by the control or measurement means. Disadvantageously, whenever the control or measurements means are damaged, fail or produce inaccurate results, there is a significant possibility that overfilling or underfilling of the container will occur.

Therefore, improvements in the control of such systems are desired.

SUMMARY OF THE INVENTION

The present invention addresses the needs identified above as well as other needs by providing a "closed-loop" moisture control system for use in vibratory mass finishing systems. The invention maintains a substantially constant amount of a polishing slurry (also referred to herein as polishing fluid) in a finishing reservoir of the vibratory mass finishing system by controlling the amount of such fluid flowing from a supply reservoir into the finishing reservoir, and/or the amount of such fluid flowing from the finishing reservoir into a collection reservoir. In operation, the weight of the supply reservoir and its contents, and the weight of the collection reservoir and its contents are monitored and, in the event there is an increase in total weight, i.e., the combined weight of the supply reservoir and the collection reservoir, a control means increases the amount of polishing fluid flowing from the supply reservoir into the finishing reservoir, and/or decreases the amount of polishing fluid flowing from the finishing reservoir into the collection reservoir. Conversely, in the event there is a decrease in the total weight, the control means decreases the amount of polishing fluid flowing from the supply reservoir into the finishing reservoir, and/or increases the amount of polishing fluid flowing from the finishing reservoir into the collection reservoir. In this way, the amount of fluid or slurry in the finishing reservoir is maintained at a substantially constant amount using a closed-loop control system (as the term closed-loop is used in the art).

BRIEF DESCRIPTION OF THE DRAWING

The FIGURE shows a schematic diagram of a closed-loop moisture control system made in accordance with the present invention.

DETAILED DESCRIPTION OF THE INVENTION

The following description of the presently contemplated best mode of practicing the invention is not to be taken in a limiting sense, but is made primarily for the purpose of describing the general principles of the invention. The scope of the invention is defined by the appended claims.

Referring to the FIGURE, a preferred apparatus is shown that comprises a vibratory mass finishing system 9, which includes a finishing reservoir or tub 10 and a vibrator or shaker table 12 with a vibratory surface 14, a power-driven slurry pump 16, a supply reservoir 18, a stirrer 20, a collection reservoir or sump 22, a vacuum pump 24, a suspension frame 26, a load cell 28, and a controller 30.

The finishing reservoir (or vibratory chamber) 10 is positioned on the vibratory surface 14 and is vibrated by the vibrator 12 as is known in the art. By way of example, the vibratory chamber may comprise a polishing and/or grinding container, e.g., a "U"- shaped or keyhole-shaped container as is known in the art of vibratory finishing systems, with a height of approximately 10 to 20 cm and an interior volume of approximately 800 cc. Such a vibratory chamber can be filled with 600 ±50 cc of polishing media (approximately 1 inch below the top of the vibratory chamber depending on how many articles, e.g., pyrocarbon coated heart valve rings, occluders and/or like objects, and how much polishing media is placed into the vibratory chamber). The finishing chamber 10 is coupled to the slurry pump 16 by a pump hose 32 through which fresh polishing slurry (or fresh polishing fluid) is received into the finishing chamber 10 at an upper port 31. The fresh slurry is pumped into the finishing reservoir 10 by the slurry pump 16 at, e.g., an average rate of 20 ml/min, in response to a control signal that is received from the controller 30. The slurry may comprise, for example, 3000 ml (or 90 weight percent) deionized water and 250 g (or 10 weight percent) polishing agent, e.g., one to fifteen micron ($\mu$) $A1_2O_3$ or SiC particles. Various suitable polishing agents and polishing slurries are commercially available from companies such as Norton Abrasives Co., KC Abrasives, and Microgrit. The fresh slurry is received into the slurry pump 16 via a supply hose 34 that is coupled to the supply reservoir 18, which contains a supply of the fresh polishing fluid. The slurry pump 16 may be a peristaltic, piston or other positive displacement pump. The supply reservoir 18 is preferably cylindrical in shape, having a height of 35 cm, and a interior volume of 3000–4000 cc, and is open at its top such that the remaining level of fresh polishing slurry contained therein can be easily viewed. The supply hose 34 is fed through the open top and positioned in the supply reservoir 18 so as to draw the fresh polishing slurry from near the bottom of the supply reservoir 18. The stirrer 20 is also positioned over the open supply reservoir top and an agitator 36 of the stirrer 20 projects down into the fresh polishing slurry. The stirrer 20 continuously stirs or agitates the slurry with the agitator 36 as is known in the art so as to prevent the polishing agent from settling near the bottom of the supply reservoir. Alternatively, a suspension agent may be used to prevent the polishing agent from settling near the bottom, in which case, the stirrer 20 may not be needed. Agents for forming thixotropic suspension are commercially available and are well known in the art.

The supply reservoir 18 is suspended by a suspension frame 26 such that substantially all of the weight of the supply reservoir 18 and the fresh polishing slurry contained therein is supported by the suspension frame 26. The stirrer 20 is independently supported such that the weight of the stirrer 20 and its agitator 36 are not supported by the suspension frame 26, and the supply hose 34 is flexible and therefore substantially does not transmit the weight, e.g., of the slurry pump 16, to the suspension frame 26.

Also supported by the suspension frame 26 is the collection reservoir (or sump) 22. The sump 22 is preferably a gas-tight (or sealed) chamber, having dimensions and a volumetric capacity approximately 5 times the volume of the supply reservoir. The sump 22 is coupled to a vacuum pump 24 via a flexible vacuum tube 38 at a vacuum port 40 near the top of the sump 22. The sump 22 is also coupled to the finishing reservoir 10 via a collection hose 42 that couples to the sump 22 at a collection port 44 and to the finishing reservoir 10 at a lower port 46, e.g., a ¼in. or 0.6 cm hole. Interposed at the entrance to the collection hose is a fine mesh screen 47. The screen 47 is a fine stainless steel woven cloth with approximately 0.010 in. openings that prevent the polishing media and the articles to be polished from passing from the finishing reservoir 10 into the collection hose 42, but allow spent polishing slurry to pass into the collection hose 42.

The vacuum pump 24 generates a substantially constant vacuum pressure in the sump 22 that draws the spent slurry (or discharge slurry) out of the finishing chamber 10 via the lower port 46 at a substantially constant rate.

The vacuum tube 38 and the collection hose 42 are flexible such that substantially no weight is transmitted to the suspension frame 26 by the vacuum tube 38 or the collection hose 42. Thus, substantially the only weights that are supported by the suspension frame are those of the supply reservoir 18 and the fresh slurry contained therein, and the collection reservoir (or sump) 22 and the spent slurry contained therein.

Also shown in the FIGURE is a valve or clamp 48 interposed in the collection hose 42 for use during servicing of the moisture control system or draining of the collection reservoir 22. Note that during the draining of the collection reservoir a drain valve 45 located near the bottom of the collection reservoir 22 is opened so as to drain the spent slurry from the collection reservoir 22 via gravity. During normal operation the drain valve 45 is left closed so as to maintain the vacuum pressure within the collection reservoir 22.

Another servicing operation during which the clamp 48 can be used to close the collection hose 42 is the removal of the articles to be ground or polished from the finishing reservoir 10. In addition, the pump 16 is turned off during removal of the articles thereby temporarily stopping the flow of slurry through the finishing system 9.

The suspension frame is preferably suspended so as to hang from the load cell 28 thereby transmitting a total weight supported by the suspension frame 26 (i.e., the weight of the supply reservoir 18 and the supply of fresh slurry contained therein, and the weight of the collection reservoir 22 and the spent slurry contained therein) to the load cell 28. In response to the transmitted weight, the load cell generates a load signal, indicative of such total weight, that is coupled to the controller 30. In this way, changes in the total weight of the supply reservoir 18 and the collection reservoir 22, and their contents, can be monitored by the controller 30.

Note that many alternative means for monitoring changes in the total weight are contemplated by the present invention. For example, the suspension frame 26 may rest upon the load cell 28, instead of being suspended therefrom, so as to transmit the weight supported by the suspension frame 26 onto the load cell. Problematically, such an alternative embodiment requires the use of a rigid suspension frame, which may be top heavy (especially early in a polishing and/or grinding run when the supply reservoir 18 is relatively full as compared to the sump 22). Alternatively, a first and a second load cell may be utilized, the first load cell supporting the supply reservoir 18 and its contents and the second load cell supporting the collection reservoir 22 and its contents (in which case the suspension frame is not utilized). In this later alternative a first and a second load signal are generated and coupled to the controller 30 and the controller 30 accounts for changes in the total weight based on the first and second load signals. Problematically, this alternative requires the use of two load cells and is more complex than the preferred embodiment.

Advantageously, in the preferred embodiment, the suspension frame 26 is suspended by the load cell 28 and includes an upper deck 49 (or platform), on which the supply reservoir is supported, and a lower deck 50 (or platform), on which the collection reservoir 22 is supported. The lower deck 50 is suspended below the upper deck 49 by three or more flexible suspension cables 52 that suspend the lower and upper decks 49, 50 in substantially horizontal positions below the load cell 28. The upper deck 49 is also suspended by the three or more suspension cables 52 below a spreader frame 54 which serves to maintain the suspension cables 52 in a substantially vertical orientation below the spreader frame 54. Above the spreader frame 54, the cables 52 come together at a suspension point 56 from which they are suspended by the load cell 28. Thus, a light-weight flexible suspension frame can be utilized with the preferred embodiment thereby providing the advantage of using only a single load cell 28, and avoiding the problem of providing a rigid, but potentially top heavy, suspension frame which can be used to support the supply and collection reservoirs 18, 22 on a single load cell.

In order to control the amount of slurry in the finishing chamber 10, the controller 30 generates the control signal based on the load signal. In response to the control signal, the slurry pump 16 speeds up or slows down so as to increase or decrease the amount of fresh polishing slurry delivered to the finishing reservoir 10. Specifically, in the event that the load signal indicates an increase in the total weight supported by the suspension frame, the controller 30 will generate the control signal so as to control the slurry pump 16 to increase the amount of fresh slurry that is delivered to the finishing reservoir 10. Conversely, in the event that the load signal indicates a decrease in the total weight supported by the suspension frame, the controller 30 will generate the control signal so as to control the slurry pump 16 to decrease the amount of fresh slurry delivered to the finishing reservoir 10. In this way, a substantially constant amount of polishing slurry is maintained in the finishing reservoir (or vibratory chamber) 10.

While the invention described herein has been described with reference to a particular embodiment and application thereof, numerous variations and modifications could be made thereto by those skilled in the art without departing from the spirit and scope of the invention as claimed. Accordingly, the scope of the invention should be determined with reference to the claims set forth below.

What is claimed is:

1. A method for precisely finishing pyrolytic carbon coated parts, which method comprises providing a vibratory chamber which contains particulate polishing media, supplying a predetermined amount of a liquid slurry containing a polishing agent to said vibratory chamber, supplying pyrocarbon objects to be finished to said chamber, vibrating said chamber so as to cause the surfaces of said pyrocarbon-coated objects to be contacted by the polishing media and the polishing agent, continuously supplying fresh liquid slurry from a reservoir to said chamber, removing liquid slurry and pyrocarbon fines in the form of a discharge slurry from a lower location in said chamber, collecting said discharge slurry in a sump, monitoring the total weight of said reservoir of fresh slurry and said sump of discharge slurry for the purpose of maintaining a constant level of overall total weight, upon detecting a decrease in said monitored total weight, slowing the rate of supply of fresh slurry to said vibratory chamber, and upon detecting an increase in said monitored total weight, increasing the rate of supply of fresh slurry to said vibratory chamber whereby the amount of liquid slurry within said vibratory chamber is maintained at said predetermined amount over a substantial period of time during which precise finishing of a batch of pyrocarbon-coated objects is achieved.

2. A method according to claim 1 wherein said liquid slurry and pyrocarbon fines are continuously removed from said vibratory chamber by the application of a vacuum.

3. A method according to claim 2 wherein said fresh liquid slurry is supplied from said reservoir to said chamber by a power-driven pump and wherein the speed of said pump is controlled so as to either slow or increase the rate of supply of fresh slurry to said vibratory

4. A method according to claim 3 wherein said slurry includes a major portion of water and a minor portion of polishing agent having an average size not greater than about fifteen microns.

5. A method according to claim 4 wherein said fresh slurry includes not more than about 25 weight percent of aluminum oxide having an average particle size of about micron.

6. A method according to claim 1 wherein said vibratory chamber contains between about 500 and about 750 grams of media having an average particle size between about 0.025 inch and 0.25 inch and wherein said predetermined amount of slurry is a volume between about 125 milliliters and about 175 milliliters.

7. A method according to claim 1 wherein said reservoir from which said fresh slurry is supplied is continuously stirred to maintain said polishing agent in suspension.

8. A method according to claim 1 wherein said liquid slurry includes a suspension agent that holds said polishing agent in suspension in said liquid slurry.

9. A method for precisely finishing pyrolytic carbon-coated parts, which method comprises providing a vibratory chamber which contains particulate media, supplying a predetermined amount of a liquid slurry containing micron-size polishing agent to said vibratory chamber, supplying pyrocarbon objects to be finished to said chamber, vibrating said chamber so as to cause the surfaces of said pyrocarbon-coated objects to be contacted by said media and polishing agent, supplying fresh liquid slurry to said chamber, removing liquid slurry and pyrocarbon fines in the form of a discharge slurry from a lower location in said chamber, and controlling the amount of said fresh slurry supplied to said chamber and the amount of discharge slurry removed from said chamber over a substantial period of time so that the amount of liquid slurry within said vibratory chamber is maintained at said predetermined amount over said substantial period of time during which precise finishing of a batch of pyrocarbon-coated objects is achieved.

10. Apparatus for precisely finishing pyrolytic carbon-coated parts, which apparatus comprises a vibratory chamber for holding a quantity of particulate media and pyrocarbon objects to be finished, a reservoir of fresh liquid slurry containing micron-size polishing agent, means for supplying a predetermined amount of liquid slurry to said vibratory chamber from said reservoir, means for vibrating said chamber so as to cause the surfaces of said pyrocarbon-coated objects to be contacted by said media and polishing agent, means for supplying fresh liquid slurry from said reservoir to said chamber, means for removing liquid slurry and pyrocarbon fines in the form of a discharge slurry from a lower location in said chamber, means for collecting said discharge slurry in a sump, means for monitoring the total weight of said reservoir of fresh slurry and said sump of discharge slurry, and control means for, upon detecting a decrease in said monitored total weight, either slowing the rate of supply of fresh slurry to said vibratory chamber or increasing the rate at which discharge slurry is removed therefrom, and for, upon detecting an increase in said monitored total weight, either increasing the rate of supply of fresh slurry to said vibratory chamber or decreasing the rate at which discharge slurry is removed therefrom, whereby the amount of liquid slurry within said vibratory chamber is maintained at said predetermined amount over a substantial period of time during which precise finishing of a batch of pyrocarbon-coated objects is achieved.

11. Apparatus according to claim 10 wherein said means for monitoring the total weight of said reservoir and said sump includes load cell means.

12. Apparatus according to claim 11 wherein said reservoir and said sump are supported by platform means suspended from load cell means.

13. Apparatus according to claim 12 wherein means is provided for continuously stirring said liquid slurry within said reservoir, which stirring means is supported independently of said platform means.

14. Apparatus according to claim 10 wherein said means for supplying fresh liquid slurry includes peristaltic pump means driven by an electric motor.

15. Apparatus according to claim 14 wherein said control means is adapted to change the speed of said electric motor to either slow the rate of supply or increase the rate of supply of fresh slurry which is being continuously supplied to said vibratory chamber.

16. Apparatus according to claim 10 wherein said sump includes a sealed container having a first flexible conduit for connection to said lower location in said vibratory chamber to remove liquid slurry and having a second flexible conduit for connection to a substantially constant source of vacuum.

17. A method according to claim 1 wherein said predetermined amount of liquid slurry is such that substantially all of said slurry adheres by surface tension to said media and said objects being finished when said chamber is being vibrated so that there is no significant excess of free liquid in said chamber.

* * * * *

UNITED STATES PATENT AND TRADEMARK OFFICE

CERTIFICATE OF CORRECTION

PATENT NO. : 5,305,554

DATED : April 26, 1994

INVENTOR(S) : Emken, et al

It is certified that error appears in the above-indentified patent and that said Letters Patent is hereby corrected as shown below:

IN THE CLAIMS: Claim 3, column 7, lines 29-30, after "vibratory", insert --chamber.--. Claim 5, column 7, line 37, after "about", insert -- 1 --.

Signed and Sealed this

Sixteenth Day of August, 1994

*Attest:*

*Attesting Officer*

BRUCE LEHMAN

*Commissioner of Patents and Trademarks*